United States Patent [19]

Scholl

[11] Patent Number: 4,910,929

[45] Date of Patent: Mar. 27, 1990

[54] ADDED DAMPING AND STIFFNESS ELEMENTS

[76] Inventor: Roger E. Scholl, 1901 Terry La., Redwood City, Calif. 94061

[21] Appl. No.: 86,415

[22] Filed: Aug. 17, 1987

Related U.S. Application Data

[63] Continuation-in-part of Ser. No. 898,271, Aug. 20, 1986, abandoned.

[51] Int. Cl.[4] ..... E04B 1/98

[52] U.S. Cl. ..... 52/167 R; 52/573

[58] Field of Search ..... 52/167, 573, 6; 403/224, 225; 248/634; 267/141.1, 294; 405/215

[56] References Cited

U.S. PATENT DOCUMENTS

| | | | |
|---|---|---|---|
| 2,655,005 | 10/1953 | Kinneman | 267/141.1 |
| 3,605,953 | 9/1971 | Caldwell et al. . | |
| 3,680,888 | 8/1972 | Hirst | 267/294 |
| 3,763,653 | 10/1973 | Shirvany | 405/215 |
| 3,797,183 | 3/1974 | Kobayashi et al. | 52/573 |
| 4,042,651 | 8/1977 | Gaurois . | |
| 4,117,637 | 10/1978 | Robinson . | |
| 4,409,765 | 10/1983 | Pall . | |
| 4,545,466 | 10/1985 | Izek et al. . | |

FOREIGN PATENT DOCUMENTS

| | | | |
|---|---|---|---|
| 1562172 | 2/1969 | France | 405/212 |
| 0012743 | 1/1977 | Japan | 52/167 |
| 0012744 | 1/1977 | Japan | 52/167 |
| 0019655 | 2/1978 | Japan | 52/167 |
| 0019656 | 2/1978 | Japan | 52/167 |
| 0912895 | 3/1982 | U.S.S.R. | 52/167 |
| 0973770 | 11/1982 | U.S.S.R. | 52/167 |
| 1088867 | 10/1967 | United Kingdom | 405/215 |

OTHER PUBLICATIONS

Roger E. Scholl, Brace Dampers: An Alternative Structural System for Improving the Earthquake Performance of Buildings, Presented at 8WCEE, July 1984, San Francisco pp 1–8.

*Primary Examiner*—James L. Ridgill, Jr.

*Attorney, Agent, or Firm*—Townsend and Townsend

[57] ABSTRACT

Disclosed is an added damping and stiffness structural element for use in optimizing the design of buildings and structures subjected to earthquake, wind or other forces that induce vibratory oscillations in buildings or structures. The added damping and stiffness element comprises conventional structural engineering materials having high shear, tension and compression moduli for transferring force from one point in a structure to another point that experience relative displacement during vibratory motion of the building or structure, and viscoelastic polymers or rubber material having lower compression, tension, and shear moduli than the structural component and also having high energy dissipation properties that absorb the majority of the strain deformation that occurs between the two points of the structure. In addition, this teaching includes the elucidation of the engineering design process which incorporates added damping and stiffness elements to optimize the earthquake response performance of structures. Specifically, the added damping and stiffness element or a plurality of the added damping and stiffness elements are placed at strategic locations in buildings or structures in such a way as to achieve two engineering design process objectives: (1) provide controlled deformation and stiffness in structures to increase the non-damaging cyclic energy capacity of structures, and (2) to increase damping in structures thereby reducing and/or minimizing the cyclic earthquake energy demand on structures. While the added damping and stiffness element is generally applicable for wind induced vibrations, earthquake induced vibrations, and vibrations induced by other types of forces, this teaching is directed primarily at earthquake vibration response design optimization.

12 Claims, 4 Drawing Sheets

ADDED DAMPING AND STIFFNESS ELEMENTS

BACKGROUND OF THE INVENTION

This application is a continuation-in-part of application Ser. No. 06/898,271, filed Aug. 20, 1986, now abandoned.

Earthquakes impose cyclic lateral forces on buildings and structures causing them to vibrate, and thus to deform and respond dynamically. Presently there exists a variety of conventional structural systems for resisting the earthquake-induced forces in the structures. In addition, there presently exists a number of patented apparatuses for improving the expected earthquake response performance of buildings or structures.

Conventional lateral force resisting structural system in seismic design include moment-resisting frames, braced frames, and shear walls. In recent years, the eccentric-braced frame, K-braced frame and other systems have been successfully proposed as alternatives for resisting lateral loads. Braced steel frames are known for their efficiency in providing lateral stiffness. Conventional concentric braced steel frames are nearly rigid. Ductile moment-resisting space frames designed to resist earthquake forces are typically flexible and these buildings or structures experience large deformations causing both nonstructural and structural damage during severe earthquakes.

Other apparatuses that are superficially similar to the apparatus of this invention include U.S. Pat. Nos. 3,605,953 (Caldwell, et al.), 4,042,651 (Gaurois), 4,117,637 (Robinson), 4,409,765 (Pall), and 4,545,466 (Iseki, et al.).

BRIEF DESCRIPTION OF THE INVENTION

The present invention is specifically directed to improving the earthquake response performance of buildings and structures, thus facilitating design optimization of such buildings and structures. The apparatus may generally be described as a moderately stiff and energy dissipating link between sets of pairs of points of a building or structure that experience relative motion as a result of vibratory oscillations. The apparatus consists basically of two major components arranged in geometric series as follows: (1) a stiff component consisting of conventional structural engineering materials having high shear, compression, and tension moduli (e.g. steel or concrete) for transferring forces from one point in the structure to another, and (2) a flexible component consisting of visoelastic polymers or rubber materials having lower compression, tension, and shear moduli than the stiff component and also having high energy dissipation properties. A crucial aspect of this teaching is that the apparatuses must be distributed somewhat uniformly through buildings or at very strategic locations in other structures.

The elastic, shear, compression and tension moduli of the stiff component of the apparatus is nominally in the range of 1,000,000 pounds per square inch to 30,000,000 pounds per square inch. For the flexible component of the appartus, the elastic shear modulus and loss shear modulus must nominally be in the range of 50 to 5,000 pounds per square inch measured at a temperature of 30° C., at a frequency of one cycle per second, and having a maximum shear strain capacity of at least one.

The following discussion is provided to illustrate the application of the apparatus for earthquake resistant design optimization, and to define the applicability of the apparatus in terms of engineering parameters typically used in performing earthquake resistant design analyses.

Earthquakes generate ground motions which impose lateral inertia forces on buildings or structures, causing the buildings (or structures) to respond dynamically (to vibrate). The amplitude of vibration of the building (or structure) depends primarily on four parameters as follows: (1) the characteristics of the ground motion at the building (or structure) site, (2) the mass of the building (or structure), (3) the stiffness of the building (or structure), and (4) the damping in the building (or structure). There are a variety of engineering characterizations available for specifying the ground motion influence on the building (or structures). One of these characterizations is the horizontal component of the ground motion and the resulting building (or structure) response Relative Velocity, commonly designated SV. The dynamic response (vibration) amplitude of the building or structure is strongly dependent on the energy dissipation characteristics (amount of damping) in the building (or structure), and response amplitude varies inversely with damping.

An engineering convenience that has evolved in recent decades is that SV values are calculated for various values of damping in a building or structure. With this feature available, it has been determined that the cyclic earthquake demand energy on a building or structure can be defined as follows:

$$ED=\tfrac{1}{2}m\,SV^2$$

where ED is the cyclic earthquake energy demand on a building or structure, m is the mass of the structure, and SV is the Relative Velocity for the appropriate value of damping in the building or structure.

Similarly, it is known that the cyclic elastic earthquake response energy capacity, ED, of a building or structure can be defined as follows:

$$EC=\tfrac{1}{2}\Delta^2K$$

where K is the stiffness of the building or structure and $\Delta$ is the deflection of the building or structure that occurs between the same two points in the structure as the points that establish the stiffness.

From the above two equations it will be seen that, for vibration-resistant design optimization purposes, the flexible component of the present invention must possess prescribed characteristics of both energy dissipation (damping) and resilience (stiffness). Conventional buildings and structures have, inherent in them, characteristics of both stiffness and damping in varying amounts. Thus a crucial aspect of this present teaching is that the apparatus is used to provide both supplemental damping and stiffness.

For earthquake resistant design optimization purposes, the supplemental damping added to a building or structure using the apparatus of this invention shall be equal to or greater than 100% of the inherent damping in the building or structure. The increase in damping will be determined by comparing the fraction of critical equivalent viscous damping in the fundamental mode of lateral or torsional vibration of the building or structure with and without the supplemental damping. Specifically, the fraction of critical damping in the fundamental mode provided by the apparatus of this invention will be divided by the fraction of critical damping in the fundamental mode inherent in the building, with this ratio multiplied by 100 to arrive at a percentage. The fraction of critical damping in the fundamental mode inherent in the building or structure shall be determined for elastic (non-damaging) response and shall be determined either from test or from contemporary published literature that specifies such damping values for various types of buildings and structures.

For similar earthquake resistant design optimization purposes, the supplemental lateral or torsional stiffness added to a building or structure using the apparatus of this invention shall be equal to or greater than 40% of the inherent lateral or torsional stiffness of the building or structure. The percentage of supplemental stiffness added using the apparatus of this invention shall be determined by dividing the added stiffness between sets of pairs of points of a building or structure that experience relative displacement or rotation as a result of earthquake motion by the inherent stiffness in the building or structure between these two same points, with this ratio multiplied by 100 to arrive at a percentage. The inherent stiffness in a building or structure shall be determined from testing or from mathematical model response simulation. The overall increase in stiffness shall be determined for an entire building or structure by averaging the increases in stiffness distributed throughout the structure.

It has been found that conventional buildings have a damping factor in the fundamental mode of vibration that is in the order of 5% of critical. Thus, by adding a 100% supplemental damping, a damping factor in the order of 10% will be present.

It has been found that the supplemental stiffness added to a building or structure using the damping and stiffness units of this invention should be equal to or greater than 40% of the inherent stiffness in the building or structure. For the case where the inherent stiffness in a building or structure is 100 pounds per inch, and the added stiffness using the apparatus of this invention is 200 pounds per inch, the supplemental stiffness is 200% of the inherent stiffness.

DETAILED DESCRIPTION OF THE DRAWINGS

Figure 1:
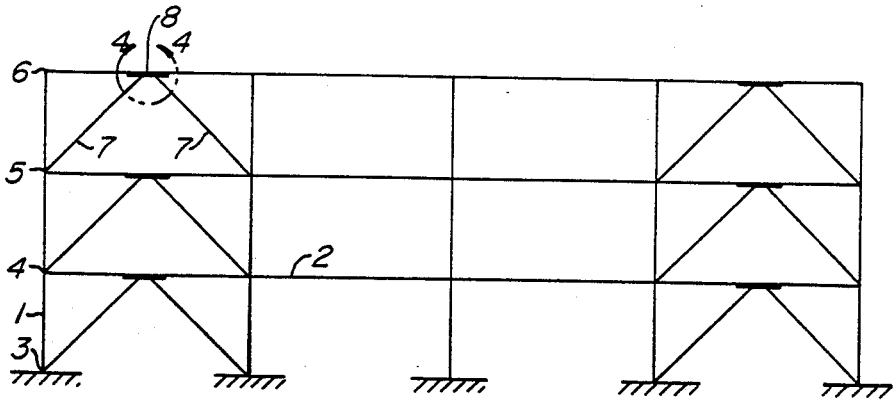
FIG. 1 is a schematic front elevation of a frame building illustrating the first embodiment of the added damping and stiffness apparatus in which the stiff component of the apparatus is represented primarily by a pair of drag struts making up an inverted V configuration and the flexible component is deformed in plane shear during vibratory motion.

FIG. 1 is a schematic diagram of a typical frame building illustrating the first embodiment of the added damping and stiffness apparatus showing unit comprised of the flexible component or solid viscoelastic member 8 and the stiff component 7 or rigid member represented by the drag struts. The building is made of columns 1, beams or floors 2, and beam-column joints 3, 4, 5, and 6. Referring to horizontal vibratory motions in the plane of the frame, a typical building will have inherent damping and stiffness, which can be physically measured from the relative displacements that occur between points 3 and 4, 4 and 5, and 5 and 6. The relative displacements in the plane of the frame that occur between pairs of points 3 and 4, 4 and 5, and 5 and 6 during vibration, deform the added damping and stiffness apparatus 7 and 8, thus mobilize the supplemental damping and stiffness of the apparatus. Where the drag struts 7 in FIG. 1 are arranged in a V configuration, a structurally feasible variation of this configuration is an inverted V.

The supplemental damping added to a building using the added stiffness and damping apparatus of the present invention is equal to or greater than 100% of the inherent damping of the building. The supplemental stiffness added to a building using the added stiffness and damping apparatus of the present invention is equal to or greater than 40% of the inherent stiffness of the building.

Figure 2:
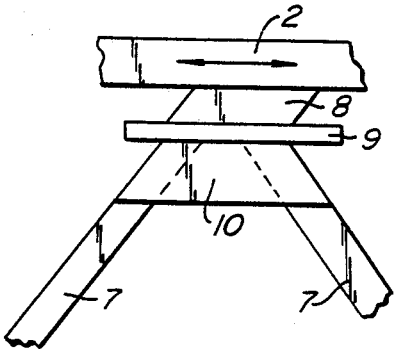
FIG. 2 is an enlarged schematic showing details of the first embodiment of the added damping and stiffness apparatus.

FIG. 2 is a schematic showing details of the first embodiment. In this illustration, the stiff component of the added damping and stiffness apparatus is made up of the drag struts 7, the strut connector 10, and the shear plate 9. The flexible component 8 of the apparatus is shown deformed in plane shear as it would be during vibratory oscillation of a building or structure.

Figure 5:
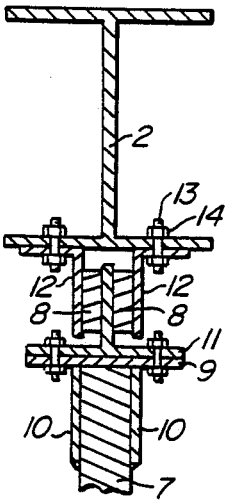

In the joint illustrated in FIG. 5, a viscoelastic material similar to that set forth in U.S. Pat. No. 3,605,953 issued Sept. 20, 1971 to Caldwell et al may be used. The properties and energy absorbing characteristics of this material are fully described therein. This material may be purchased under the trademark Scotch Damp® from the 3M Company of St. Paul, Minn. This material may be ordered made to specification.

Figure 3:
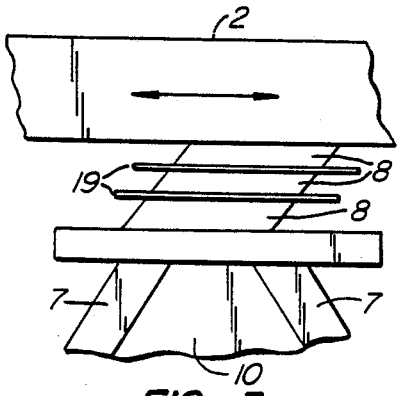
FIG. 3 is an enlargement of FIG. 2 showing heat dissipation plates layered into the flexible component of the apparatus.

FIG. 3 is an enlargement of FIG. 2 showing an alternative arrangement of the flexible component, with heat dissipation plates. These plates dissipate Joule heating.

Figure 4:
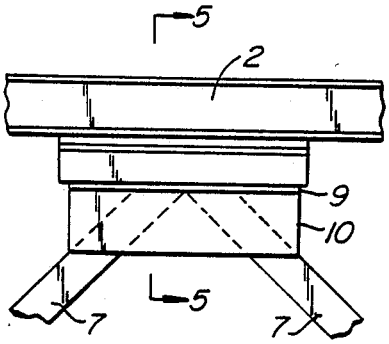
FIGS. 4 and 5 are schematics showing a variation of the first embodiment.

FIGS. 4 and 5 are schematic details of a variation of the first embodiment illustrating the connection of the flexible component of the apparatus 8 to the beam or floor 2 through a structural angle 12 and the connection of the flexible component 8 to the stiff component 7, 9, and 10 through a structural tee 11.

Figure 6:
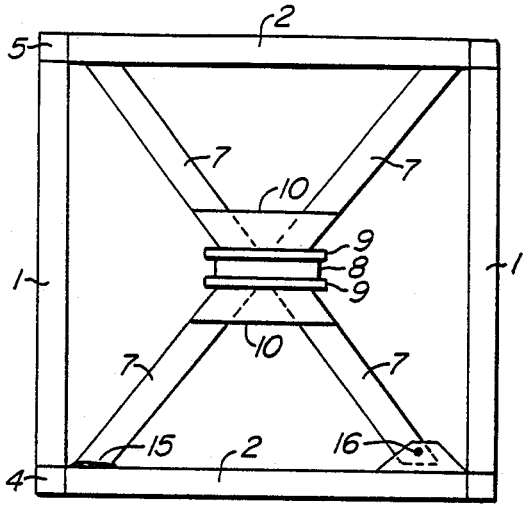
FIG. 6 is a schematic of the second embodiment of the apparatus in which the stiff component is represented primarily by a structural X configuration and the flexible component is deformed in plane shear during vibratory motion.

FIG. 6 shows a single bay of a building or structure and is a schematic representation of the second embodiment of the added damping and stiffness apparatus in which the stiff component 7, 9, and 10 is configured in the frame of a building or structure having beams or floors 2 and columns 1 with a mirror-image as a pair of V configurations thus making up an X configuration with the flexible component 8 being deformed in plane shear during vibratory motion of the building or structure. FIG. 6 also shows that the drag struts 7 can be connected to the beams or floors 2 with either a welded connection 15 or a bolted connection 16.

Figure 7:
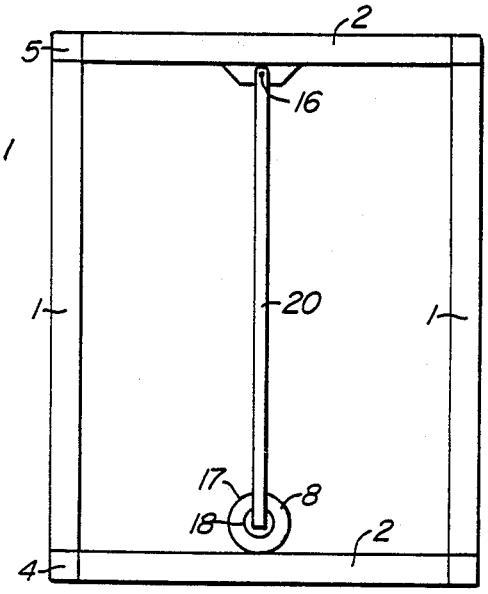
FIG. 7 is a schematic of the third embodiment of the added damping and stiffness apparatus in which the flexible component is configured in an annular shell and is deformed in annular torsional shear when relative displacement is imposed on a building or structure by vibratory motion.

FIG. 7 shows a single bay of a building or structure made up of beams or floors 2 and columns 1 illustrating a schematic representation of a third embodiment of the added damping and stiffness apparatus. The stiff component is represented by the crank 20 connected to an inner tubular shell or bar 18 and the outer tubular reaction shell 17. The flexible component is configured in an annular shell and is deformed in annular torsional shear when relative displacement between points 4 and 5 of the frame is induced by vibratory motion. The crank 20 is connected to one beam through a bolted connection 16 and the outer tubular reaction shell 17 is rigidly attached to the other beam. A structurally feasible alternative is to invert this arrangement.

Figure 8:
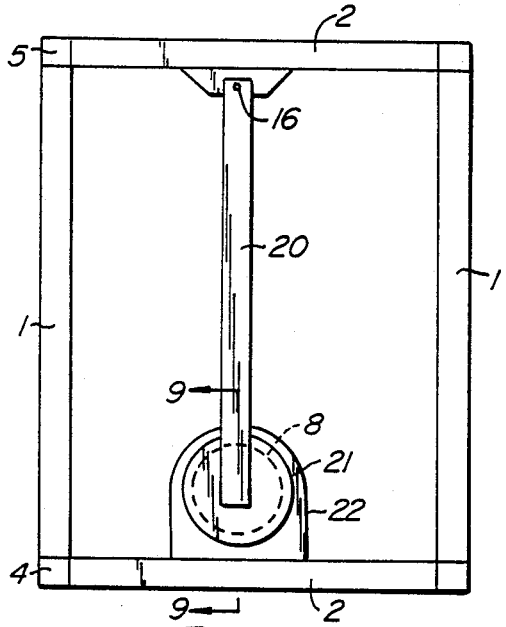
FIG. 8 is a schematic of a fourth embodiment of the added damping and stiffness apparatus in which the flexible component is configured in a plate and is deformed in plane torsional shear when relative displacement is imposed on a building or structure by vibratory motion.
Figure 9:
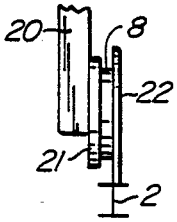
FIG. 9 is a section of FIG. 8 showing details of the FIG. 8 embodiment.

FIGS. 8 and 9 show a single bay of a building or structure made up of beams or floors 2 and columns 1 illustrating a fourth embodiment of the added damping and stiffness apparatus in which the stiff component is represented by the crank 20 connected to an action plate 21 and the reaction plate 22. The flexible component 8 is configured in a plate and is deformed in plane torsional shear when relative displacement between points 4 and 5 is induced by vibratory motion. The crank 20 is connected to the beam or floor aligned with point 5 through the bolted connection 16, and the reaction plate 22 is rigidly attached to the other beam or floor aligned with point 4. A structurally feasible alternative is to invert this arrangement.

Figure 10:
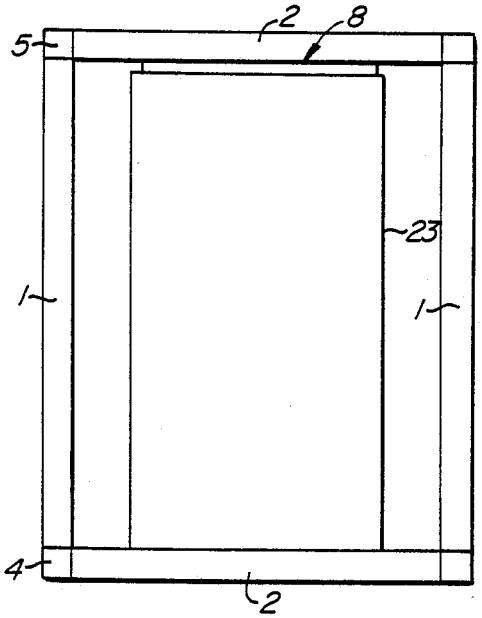
FIG. 10 is a schematic of a fifth embodiment of the added damping and stiffness apparatus in which the stiff component is represented by the shear wall or shear transfer column and the flexible component is deformed in plane shear when relative displacement is imposed on a building or structure by vibratory motion

FIG. 10 shows a single bay of a building or structure made up of beams or floors 2 and columns 1 schematically illustrating a fifth embodiment of the added damping and stiffness apparatus in which the stiff component is represented by a shear wall or shear transfer column 23 and is firmly attached to the beam or floor 2 aligned with point 4. The flexible component 8 is positioned between the stiff component 23 and the beam or floor aligned with point 5 and is deformed in plane shear when relative displacement between points 4 and 5 is induced by vibratory motion. A structurally feasible alternative is to invert the arrangement of the stiff component 23 and the flexible component 8.

Figure 11:
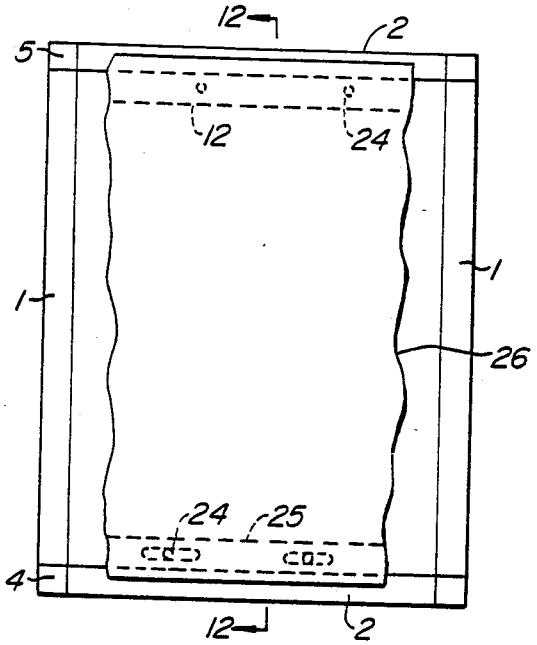
FIG. 11 is a schematic of a sixth embodiment of the added damping and stiffness apparatus in which the stiff component is represented by a building or structure exterior curtain wall and the flexible component is deformed in plane shear when relative displacement is imposed on a building or structure by vibratory motion.
Figure 12:
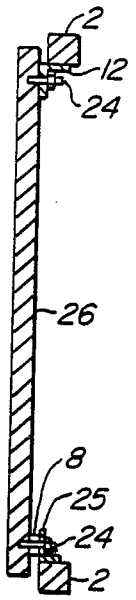
FIG. 12 is a section of FIG. 11 showing details.

FIGS. 11. and 12 show a single bay of a building or structure made up of beams 2 and columns 1 schematically illustrating a sixth embodiment of the added damping and stiffness apparatus in which the stiff component is primarily represented by the building or structure exterior curtain wall 26 and is firmly attached to the beam or floor 2 aligned with point 5 through the structural angle 12 and the anchor bolts 24. The flexible component 8 is positioned between the stiff component 26 and the slotted structural angle 25 and is bonded firmly to both pieces. The slotted structural angle is firmly attached to the beam 2 aligned with point 4. The flexible component 8 is deformed in plane shear when relative displacement between points 4 and 5 is induced by vibratory motion of the building or structure. A structurally feasible alternative is to invert the arrangement of the structural angle 12 and the slotted structural angle 25. Another structurally feasible alternative is to firmly attach the slotted structural angle 25 to the curtain wall 26 and place the flexible component 8 between the slotted structural angle 25 and the beam or floor 2, with the flexible component 8 firmly bonded to both the slotted structural angle 25 and the beam or floor 2.

Referring to FIGS. 13–16, respective plan views of typical buildings are illustrated. In the respective plan views, the illustrated heavy lines disclose locations of the added damping and stiffness elements of this invention.

A few general remarks about the location of such added members can be made.

First, the members are preferably added symmetrically. That is to say, they are added to provide the same amount of relative added stiffness and relative added damping along the respective major and minor axes of the building.

Secondly, the reader will understand that the resultant center of mass and center of stiffness of the building are preferably coincident once the added damping and stiffness elements have been installed by insertion.

It will thus be seen that the added damping and stiffness element can be placed to correct non-coincidence of the center of mass with the center of stiffness.

Figure 13:
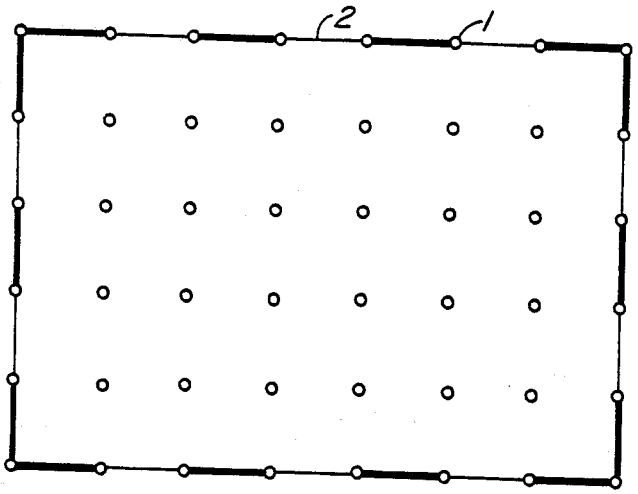
FIG. 13 is a schematic plan view of a building floor showing typical locations of added damping and stiffness elements which are located at the perimeter of the building and are oriented orthogonally to each other and parallel to the major and minor axes of the building.

Referring to FIG. 13, the added damping and stiffness elements are shown around the entirety of the periphery of the building. For example, the curtain wall embodiment of this invention shown in FIG. 11 could well be used.

Figure 14:
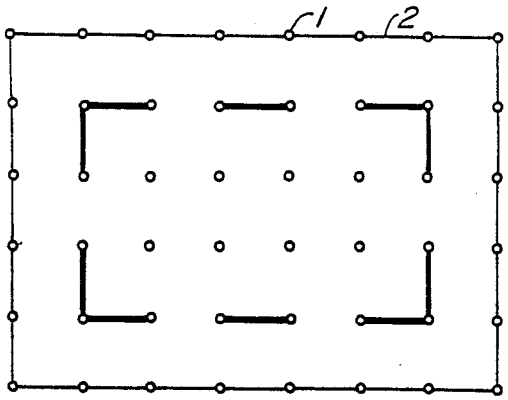
FIG. 14 is a schematic plan view of a building floor showing typical locations of added damping and stiffness elements which are located in the interior of the building and are oriented orthogonally to each other and parallel to the major and minor axes of the building.

Referring to FIG. 14, the added damping and stiffness elements are shown placed symmetrically between supporting columns approximately equidistant from the center of the building to the side edges.

Figure 15:
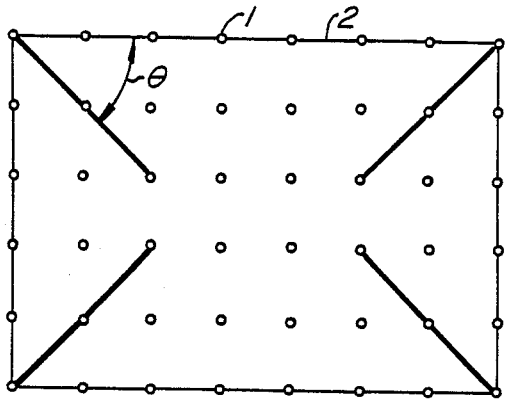
FIG. 15 is a schematic plan view of a building floor showing typical locations of added damping and stiffness elements which are located in the interior of the building and are oriented at an angle $\theta$ with respect to the major axis of the building.

Referring to FIG. 15, the added damping and stiffness elements are placed diagonally between the respective columns. It will be noted that this diagonal placement is symmetrical; one end of the building is identically diagonally reinforced with respect to the other end of the building.

Figure 16:
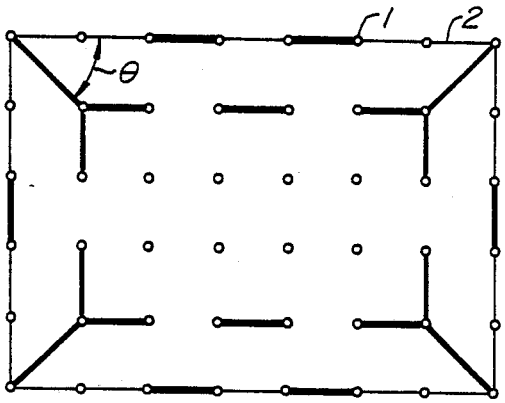
FIG. 16 is a schematic plan view of a building floor showing typical locations of added damping and stiffness elements which are located at both the interior and perimeter of the building and are oriented both at an angle $\theta$ with respect to the major axis of the building and orthogonally to each other and parallel to the major and minor axes of the building.

Finally, FIG. 16 shows a combination of peripheral central and diagonal bracing.

What is claimed is:

1. In apparatus for absorbing seismic energy exerted on a building having a plurality of spaced beams and an inherent damping and stiffness:

a plurality of damping and stiffening units for the building, each unit being provided for a respective pair of adjacent beams of the building, each unit including a first rigid member adapted to be secured to one of the respective pair of beams and to extend toward the other of the respective pair of beams, and a second, solid viscoelastic member coupled to the first member and adapted to be secured to the other of said beams, said second member being movable in shear relative to the other beam when the one beam moves longitudinally with respect to and parallel with the other beam, said units being operable to add supplemental damping to the building equal to or greater than 100% of the inherent damping of the building and to add supplemental stiffness to the building equal to or greater than 40% of the inherent stiffness of the building.

2. In apparatus as set forth in claim 1, wherein said first member of each unit includes a pair of rigid struts having first ends for attachment to said one beam and second ends for coupled relationship with the other member.

3. In apparatus as set forth in claim 2, wherein the struts converge towards each other as the second member is approached.

4. In apparatus as set forth in claim 1, wherein the second member of each unit has a heat dissipating plate thereon.

5. In apparatus as set forth in claim 1, wherein said first member of each unit has a flange thereon at the end thereof adjacent to the second member, said second member having a pair of parts secured to opposite faces of the flange, and angle means coupled with said parts for securing the parts to the other beam.

6. In apparatus as set forth in claim 1, wherein said first member of each unit includes a rigid shear wall adapted to extend between the beams and to terminate near the other beam, said second member being secured to the outer edge margin of the shear wall and adapted to be secured to the other beam.

7. In a building:

a pair of spaced beams;

a damping and stiffening unit for said pair of beams, said unit including a first rigid member secured to one of the beams and extending toward the other beam, and a second, solid viscoelastic member coupled to the first member and to the other of said beams, said second member being movable in shear relative to the other beam when the one beam moves with respect to and parallel with the other beam.

8. In apparatus as set forth in claim 7, wherein said first member includes a pair of rigid struts having first ends attached to said one beam and second ends coupled with the second member.

9. In apparatus as set forth in claim 8, wherein the struts converge towards each other as the second member is approached.

10. In apparatus as set forth in claim 7, wherein the second member has a heat dissipating plate thereon.

11. In apparatus as set forth in claim 7, wherein said rigid member has a flange thereon at the end thereof adjacent to the second member, said second member having a pair of parts secured to opposite faces of the flange, and angle means coupled with said parts for securing the parts to the other beam.

12. In apparatus as set forth in claim 1, wherein said first member includes a rigid shear wall extending between the beams and terminating near the other beam, said second member being secured to the outer edge margin of the shear wall and secured to the other beam.

* * * * *